United States Patent [19]

Shaheen

[11] 4,133,341

[45] Jan. 9, 1979

[54] TENT CANOPY SUPPORTED BY A PLATE AND SPRING WOUND STRAND

[76] Inventor: Virginia Shaheen, 5 Junction Rd., North Reading, Mass. 01864

[21] Appl. No.: 885,494

[22] Filed: Mar. 13, 1978

Related U.S. Application Data

[63] Continuation-in-part of Ser. No. 779,351, Mar. 21, 1977, abandoned.

[51] Int. Cl.[2] ..... A45F 1/16

[52] U.S. Cl. ..... 135/1 D; 135/3 C; 135/15 PQ; 135/15 PE

[58] Field of Search ..... 135/1 D, 3 C, 4 B, 15 PQ

[56] References Cited

U.S. PATENT DOCUMENTS

| | | | |
|---|---|---|---|
| 3,874,397 | 4/1975 | Oberhaus | 135/2 |
| 3,875,952 | 4/1975 | Black | 135/1 D X |

FOREIGN PATENT DOCUMENTS

| | | | |
|---|---|---|---|
| 9235 of | 1900 | United Kingdom | 135/DIG. 1 |

*Primary Examiner*—Price C. Faw, Jr.
*Assistant Examiner*—Conrad L. Berman
*Attorney, Agent, or Firm*—Pearson & Pearson

[57] ABSTRACT

A portable, quick-assembled tent includes a central tent pole with a horizontal, circular plate and an upstanding housing threadedly mounted thereon. The housing supports a stack of at least three spring retraction, lockable spools of strand, each rotatable in a horizontal plane on a vertical axis. The free terminal end of each strand is unwound against spring pressure and anchored at a spaced distance from the bottom of the pole. A canopy of limp fabric has its closed upper end draped over the central pole and its larger area, lower, open, end held extended by the strands.

10 Claims, 3 Drawing Figures

TENT CANOPY SUPPORTED BY A PLATE AND SPRING WOUND STRAND

CROSS REFERENCE TO RELATED APPLICATION

This application is a continuation-in-part of my application Ser. No. 779,351 filed Mar. 21, 1977 and now abandoned.

PRIOR ART

The following patents are considered pertinent:

U.S. Pat. No. 1,270,701
U.S. Pat. No. 2,865,385
U.S. Pat. No. 3,406,698
U.S. Pat. No. 988,400
U.S. Pat. No. 1,409,316
U.S. Pat. No. 2,282,433
U.S. Pat. No. 2,873,750
U.S. Pat. No. 3,874,397
U.S. Pat. No. 2,842,145
U.S. Pat. No. 3,875,952

Especially pertinent is U.S. Pat. No. 3,875,952 to Black of Apr. 8, 1975, wherein a central pole with a spoked mount thereon supports a plurality of pulleys rotatable on horizontal axes for raising and lowering the side walls of a tent. The bottom of the side walls of the tent contains a built in ring, which is not anchored to the ground, nor are the strands on the pulleys anchored to the ground, so that a strong wind could probably billow the tent bottom like a hoop skirt.

BACKGROUND OF THE INVENTION

This invention relates to a tent construction for use in outdoor camping.

An object of the invention is to provide a tent construction which can be quickly and simply assembled and disassembled.

SUMMARY OF THE INVENTION

This invention provides a tent of simple construction which can be assembled and disassembled quickly. The tent includes a canopy and a central support pole for the canopy. A plurality of spring retracted, lockable spools for wire and a mounting plate are attached to the top of the pole under the canopy, the spools being rotatable in horizontal planes on a vertical axis. The wires when extended, from the spools and around the plate are anchored in the ground and support the side wall of the canopy, with the large diameter, lower end thereof in extended condition.

DETAILED DESCRIPTION OF THE PREFERRED EMBODIMENT

Figure 1:
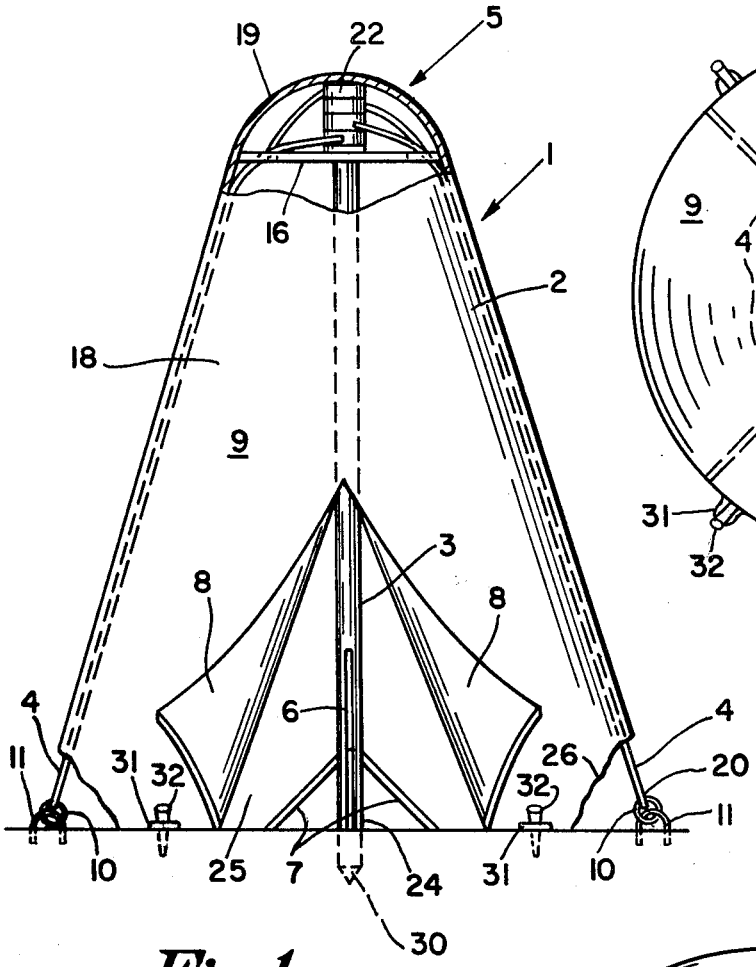
FIG. 1 is a side elevational view of the tent of this invention.
Figure 2:
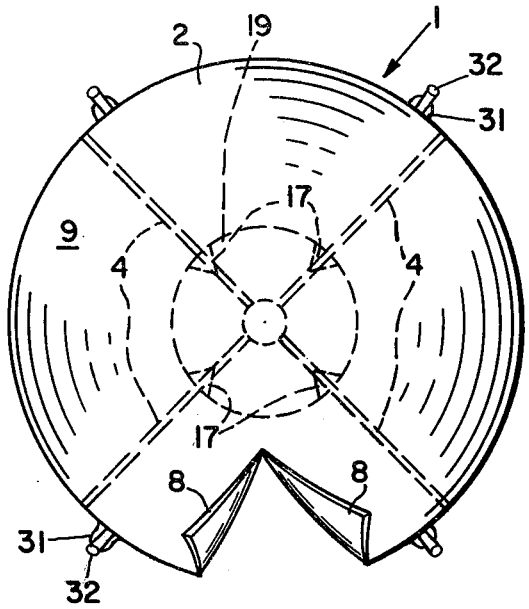
FIG. 2 is a plan view of the tent of FIG. 1.

Referring to FIG. 1, the tent 1 comprises a canopy 2, a centrally located support pole 3 and support wires 4 extending from wire housing 5. The support pole 3 includes slot 6 within which auxiliary supports 7 can be slid and locked. The canopy 2 includes flaps 8 to form an entrance into the tent 1. The wires 4 each are attached to rings 10 which are anchored into the ground with U-shaped pegs 11. The wires 4 are wound on rotatable spools 12 which when placed on a centrally positioned support 13 between top spool support 14 and bottom spool support 15 form the wire housing 5. The support 13 is attached to pole 3 such as by being screwed into pole 3.

When the wires 4 are unwound from the spools 12, they extend over mounting plate 16 which may include wire retaining slots 17 per each wire. The wires are extended the desired length and are anchored by the rings 10 and pegs 11 as shown. The canopy 2 then is placed over the top spool support 14 and extended wires 4 which provide support for the canopy 2.

The canopy 2 is preferably of waterproof fabric 18 which is limp and contains no upper or lower built-in rings, as used in the prior art. It has a closed, upper end 19 which is draped over the cap 14 of the housing 5 and the side wall 9 of the canopy 2 would normally fall downwardly around the periphery of the plate 16 with little usable enclosed space. However, the free terminal end 20 of each strand, or wire, 4 is pulled out of its slot 21, in its casing 22, and drawn through the notches 17 in plate 16 (to rotate its reel, or spool, 12, against the retracting effect of its spring 23) and anchored at ground level at a spaced distance from the bottom 24 of pole 3 to create a wide area enclosure 25 of more than human adult height at the open lower larger end 26 of the canopy.

The canopy erection means 27 thus includes the horizontal, apertured plate 16, the vertical stack 28 of at least three spring retraction spools, such as 12, each rotatable on a vertical axis in a horizontal plane, conventional locking mechanism 29 such as a pivoted pawl to lock the strands in extended condition and the rings 10 and pegs 11 which anchor the ends 20 to the ground.

For disassembly the canopy 2 may be removed and folded into a compact package, the plate 16 and housing 5 may be separated from the pole 3 by unthreading at 27, the legs 7 housed in their slots 6 and the pole may be telescoped, unthreaded in sections or pivotably folded to form a small convenient package for storage or travel.

Figure 3:
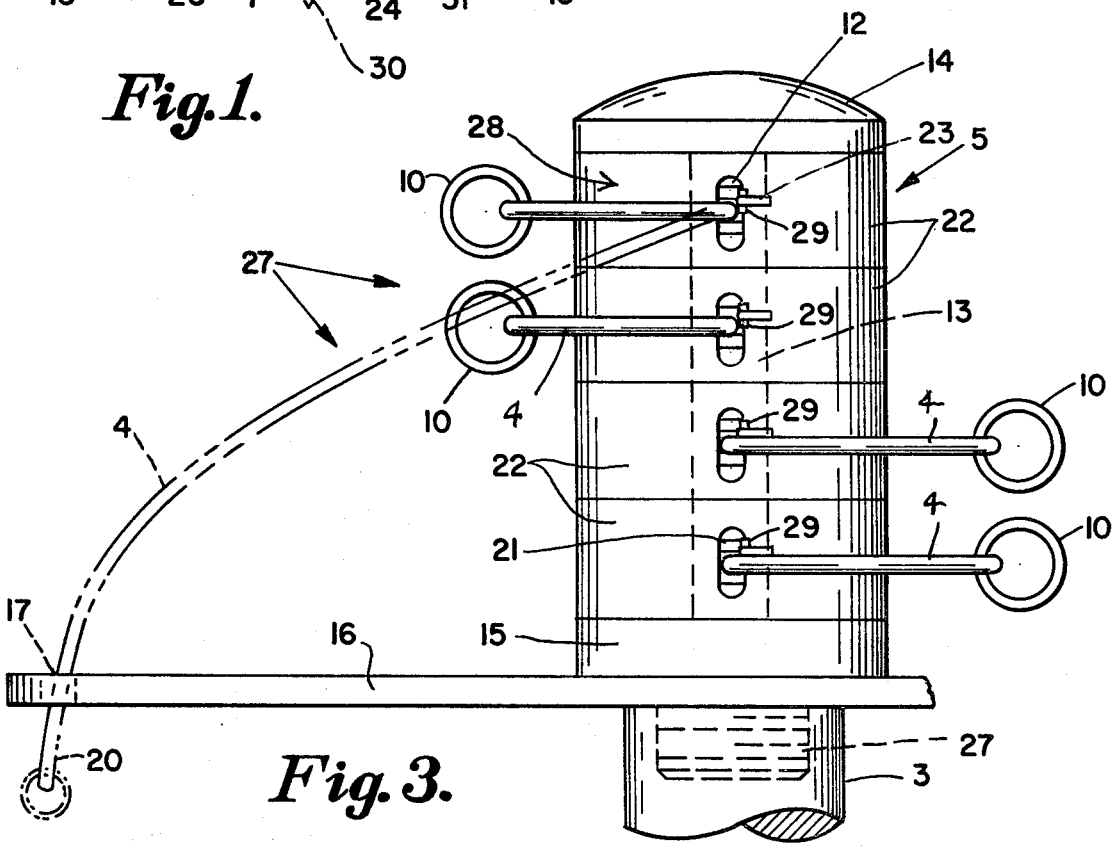
FIG. 3 is a detailed side view of the canopy support.

In FIG. 3 the rings 10 and strands 4 are shown horizontal for clarity but it will be understood that they normally would hang by gravity or would be spring pressed, with the rings 10 retained in the notches 17 ready to be reached and pulled down by the user after the spade end 30 of the pole has been inserted in the ground.

The side wall 9 of canopy 2 may be rolled up from the bottom without affecting the central pole 3 or its anchored guy wires 4, to open the tent for cleaning, or drying the contents in the sun, and the open large lower end 26 thereof is held down against the wind by the conventional loops 31 and tent pins 32.

The locking mechanism 29 may also be the notches 17, which are preferably V shaped, to frictionally retain the wires 4 when taut but to permit easy release when the rings 10 are released from the U shaped pegs 11.

It is to be understood that at least three wires should be employed to produce a supported tent of useful support and that any greater number of wires can be employed, usually four or five wires. Furthermore, any flexible line other than wire such as cord, can also be used.

It is to be understood that the present invention is not limited to the specific embodiments shown but includes obvious modifications thereof which will be evident to the person skilled in the art.

I claim:

1. A portable, quickly assembled and disassembled tent comprising:

a. canopy of limp fabric having a closed upper end;

b. a tent pole having a horizontal plate and a vertical wire housing fixed to the upper end thereof, said plate and housing supporting the closed upper end of said canopy;

c. at least three spools of flexible line each rotatable in a horizontal plane on a common vertical axis within said housing, each line having a free terminal end withdrawable from said housing;

means for anchoring the said free terminal end of each flexible line to the ground at a spaced distance from the bottom of said pole, when said lines are unwound from said spools;

said pole, plate and wire housing and extended wires comprising means to support said canopy to form an enclosed space.

2. The tent of claim 1 wherein said horizontal plate includes a plurality of peripheral notches through each of which, one said line is threaded when extended.

3. The tent of claim 1, wherein said flexible lines are metal wire, and said spools are spring actuated toward wind up.

4. The tent of claim 1 wherein:

there are four said flexible lines and the notches in said plate are V shaped.

5. The tent of claim 1, wherein said anchoring means includes:

a ring on the end of each of said flexible line;

a U-shaped peg received through each ring, and means for releasably anchoring the lower end of said canopy to the ground.

6. A portable, quickly assembled and disassembled tent, comprising:

a canopy of limp, waterproof fabric of generally truncated conical configuration when erected, said canopy having an upper, small, closed end and a lower, larger open end;

a central vertical tent pole having a lower end supported at ground level and an upper end above normal human adult height, and canopy erection means mounted on the upper end of said pole, said means including a horizontal mounting plate of substantial area and a wire housing upstanding from the centre thereof, the small closed end of said canopy being supported thereover, said housing containing a vertical stack of at least three spring retractable, spools each rotatable in a horizontal plane on a common vertical axis and each having a wire wound thereon with a free terminal end extended around the periphery of said plate, down along the inside of said canopy and anchored at ground level at a spaced distance from the lower end of said pole to support the open lower end of said canopy in extended condition.

7. A portable, quickly assembled and disassembled tent, as specified in claim 6, plus:

locking means operably associated with each said wire for releasably locking said wire in extended, anchoring, position against movement relative to said plate and wire housing.

8. A portable, quickly assembled and disassembled tent, as specified in claim 6, plus:

at least three auxilliary supports, or legs, each slidable in a slot in the bottom of said central pole and each extendable therefrom to a position inclined thereto for bracing said pole.

9. A portable, quickly assembled and disassembled tent, as specified in claim 6, wherein:

said canopy erection means is threadedly connected to the upper end of said pole for removal when said tent is to be stored or shipped.

10. A portable, quickly assembled and disassembled tent as specified in claim 6, wherein said horizontal plate includes a plurality of V-shaped notches in the periphery thereof, each for one of said wires, whereby upon erection of said tent each wire is frictionally retained in its notch to prevent movement thereof relative to said plate when said tent is erected but to permit release thereof when said tent is to be disassembled.

* * * * *